United States Patent [19]

Prouty et al.

[11] Patent Number: 4,706,037

[45] Date of Patent: Nov. 10, 1987

[54] SOFT-CONTACT SOLENOID CONTACTOR

[75] Inventors: Robert E. Prouty; S. Michael Cunningham, both of Logansport, Ind.

[73] Assignee: Hamilton Standard Controls, Inc., Farmington, Conn.

[21] Appl. No.: 945,143

[22] Filed: Dec. 22, 1986

[51] Int. Cl.[4] ..... H01F 7/12

[52] U.S. Cl. ..... 335/248; 335/131; 335/277; 335/193

[58] Field of Search ..... 335/129, 130, 131, 132, 335/133, 193, 247, 248, 249, 257, 271, 277

[56] References Cited

U.S. PATENT DOCUMENTS

| | | | |
|---|---|---|---|
| 1,803,908 | 5/1931 | Lansing . | |
| 2,278,967 | 4/1942 | Allen | 175/341 |
| 2,391,277 | 12/1945 | Stapleton | 175/341 |
| 2,414,961 | 1/1947 | Mason et al. | 200/111 |
| 2,907,847 | 10/1959 | Grenier et al. | 200/104 |
| 3,099,725 | 7/1963 | Grenier | 200/87 |
| 3,130,284 | 4/1984 | Woods | 200/111 |
| 3,189,705 | 6/1965 | Geusendam | 200/87 |
| 3,571,770 | 3/1971 | Dew | 335/256 |
| 3,992,687 | 11/1976 | Schantz et al. | 335/248 |

*Primary Examiner*—Clifford C. Shaw
*Assistant Examiner*—Lincoln Donovan
*Attorney, Agent, or Firm*—Stephen A. Schneeberger

[57] ABSTRACT

A solenoid contactor arrangement facilitates soft contact between the movable and stationary contacts and provides for overtravel of an armature in a manner which ensures that good and consistent electrical contact is maintained between the movable and the stationary contacts. The movable contacts are carried on an axially reciprocable armature assembly and are afforded limited axial displacement relative thereto. The movable contacts are biased by a coil spring to a first position on the armature assembly in preparation for engagement with the stationary contacts. When that engagement occurs, the movable contacts stop, the spring yields, and further displacement of the armature assembly occurs until a stop on it firmly contacts and is stopped by a corresponding stop on the movable contacts. The spring is formed and positioned such that it does not dimensionally interfere with the firm contact between the movable contacts and the armature assembly. In the overtravel position, a predetermined small air gap is maintained between the armature and a pole piece to maximize the contact-engaging forces.

5 Claims, 3 Drawing Figures

SOFT-CONTACT SOLENOID CONTACTOR

TECHNICAL FIELD

The invention relates to that of electromagnetic switches and more particularly to that of soft contact, electromagnetically switchable devices such as solenoid contactors. Background Art The technology of electromagnetic switches, including solenoid contactors, has been the subject of considerable refinement. One such refinement has involved the provision of a so-called "soft contact" between the moving contacts and the stationary contacts of the switch assembly. In such arrangements, a spring is typically provided to cushion the impact of the moving contacts upon engagement with the stationary contacts thereby to minimize bounce and wear. Examples of such capabilities are depicted and disclosed in U.S. Pat. Nos. 2,391,277 and 2,414,961 where part of the armature assembly carrying the movable contacts is permitted to move relative to those contacts against the opposing force of a cushioning spring. Still further in the aforementioned U.S. Pat. No. 2,414,961, there is provision for the armature assembly to move relative to the movable contact structure to such extent that its travel is completed when the cushioning spring reaches the limit of its movement and bears against the moving contact structure. In that limit position, there remains a desired air gap between the attracting surfaces of the armature and the opposing pole piece. On the other hand, the dimensional control of that air gap may be made somewhat difficult by the fact that the dimensional characteristics of the cushioning spring are necessarily interposed between the armature assembly and the movable contacts carried thereby. Variations in the axial dimensions of the cushioning spring will correspondingly affect the aforementioned air gap.

DISCLOSURE OF INVENTION

It is a principal object of the present invention to provide an improved solenoid contactor arrangement which facilitates soft contact between the moving and stationary contacts and which further results in the accurate dimensional control of a resulting air gap. Included within this object is the provision of such improved solenoid contactor which is of relatively low cost and simple construction.

According to the invention, there is provided an improved solenoid contactor arrangement including a housing which contains first and second stationary terminal contacts, selectively energizable electromagnetic coil means and an armature assembly carrying movable contact means for bridging said first and second stationary terminal contacts upon energization of the coil means. The improvement is characterized by the structure of the armature assembly wherein provision is made for initial soft contact between the movable contacts and the stationary contacts in the "make" position and wherein further provision is made for overtravel of the armature to a position of rigid contact between the armature assembly and the movable contacts carried thereby in the final "overtravel" position, while maintaining an air gap of desired axial dimension.

The armature assembly includes a magnetic armature or plunger having a spindle-shaped carrier extending axially therefrom. The movable contacts are carried by a contact bridge which is mounted on the carrier for limited axial displacement relative thereto. A flange on the carrier limits outward axial movement of the contact bridge. A similar flange or head formed on a sleeve which encircles the carrier limits movement of the contact bridge in the opposite direction. A spring acts between the sleeve and the contact bridge for providing the desired cushioning effect; however, the positioning and dimensioning of that spring with respect to the sleeve and contact bridge are such as to prevent variations in its characteristics from altering the dimensions of the air gap from those desired. The dimensional characteristics of the air gap are further ensured by forming a bias or stop on the contact bridge for establishing its limiting contact with the sleeve. Overtravel of the remainder of the armature assembly with respect to the contact bridge ends with the sleeve making solid physical contact with the contact bridge. A remaining air gap of small, predetermined dimension ensures that magnetic force is maximized at the end of travel and thus serves to maintain good electrical contact between the movable and stationary contacts.

Other features and advantages will be apparent from the specification and claims and from the accompanying drawings which illustrate an embodiment of the invention.

BEST MODE FOR CARRYING OUT THE INVENTION

Figure 1:
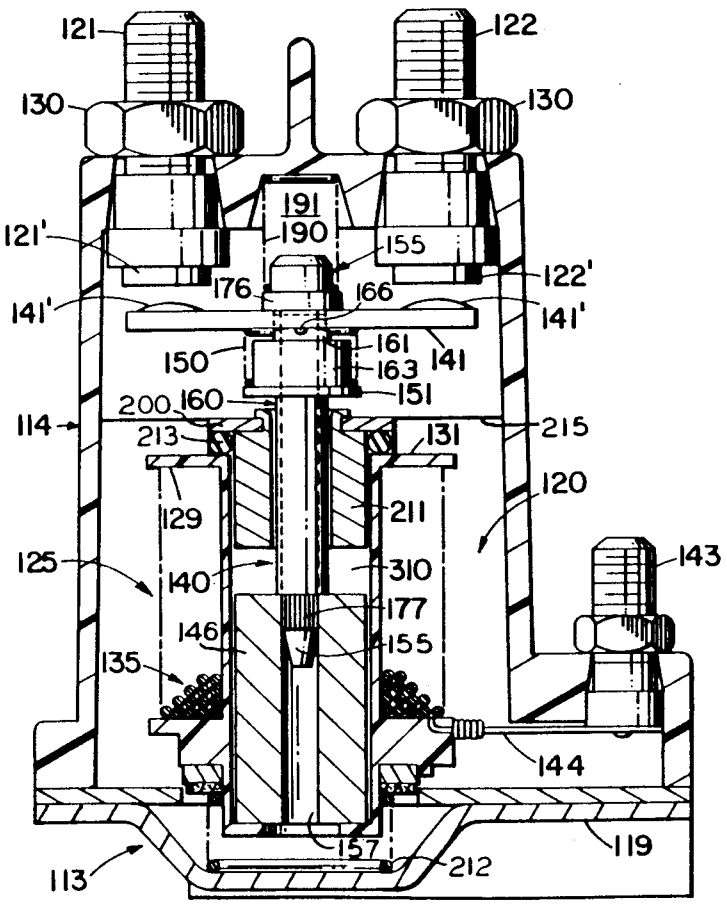
FIG. 1 is a detailed vertical cross section of a preferred version of the solenoid contactor according to the invention, with the armature assembly at its "open" position.

FIG. 1 shows a solenoid contactor arrangement 113 according to the invention, which arrangement includes an outer housing 114 preferably made of a selected molded plastic material formed to include a lower base portion 119 and a central cavity portion 120 for holding a coil assembly 125.

The coil assembly 125 includes a central bobbin 131 with suitable magnet wire 135 wound thereabout. The bobbin 131 includes a central aperture at its axis for receiving an armature assembly 140 freely slidable axially therein. The coil assembly 125 includes a respective pair of lead wires 144 (only one shown) connected at its opposite ends and in turn connected to a respective pair of terminals 143 (only one being shown). In a known manner, when a control signal is applied to the terminals 143, the resulting current in the coil wire 135 results in a magnetic field which causes the armature assembly 140 to be displaced axially in a particular direction.

Also included as a stationary part of the magnetic circuit, which includes coil assembly 125, are the magnetic frame 200 and the associated pole piece 211. The magnetic frame is of inverted U-shape and embraces the coil assembly 125 in known manner. The pole piece 211 is generally tubular in shape and depends in joined fashion from a central aperature in magnetic frame 200 and into the central aperture in bobbin 131. Magnetic frame 200 and pole piece 211 provide a flux path for the magnetic field created by the windings 135. A spring 212 acts against housing base portion 119 and against the underside of bobbin 131 to urge the bobbin upwardly. Such force and resulting displacement are transmitted via an O-ring 213 to the magnetic frame 200 such that the entire magnetic assembly is urged upward into limiting engagement with a shoulder 215 formed in the housing 114.

A pair of stationary contacts 121′ and 122′ respectively are positioned in known manner in the upper portion of housing 114 and include respective threaded terminal portions 121 and 122 extending through corresponding apertures in the housing. Nuts 130 in threaded engagement with the terminal portions 121 and 122 serve to fixedly position the contacts 121′ and 122′ within the housing 114. The armature assembly 140 includes a rigid, electrically-conductive contact bridge 141 having a pair of contact portions 141′ at opposite ends thereof for selective conductive contact with the stationary contacts 131′ and 132′ in a generally known manner to be hereinafter described in greater detail.

The armature assembly 140 comprises a plunger or armature 146, the contact bridge 141, and a carrier subassembly which couples contact bridge 141 to plunger 146. The carrier subassembly includes a generally rod-like carrier 155, a stop sleeve 160 surrounding carrier 155 for part of the length of the carrier and a cushioning spring 150. The carrier 155 includes knurling 177 toward its lower end for press-fitted insertion into an axial bore 157 in the magnetic plunger 146. Carrier 155 extends upwardly from plunger 146 through a central bore in pole piece 211 and also through a central aperture in contact bridge 141. A flange 176 positioned at or near the upper or outer end of carrier 155 serves, at its inner surface, to limit relative outward displacement of contact bridge 141 and, at its outer surface, to provide a spring seat for a biasing spring 190. The biasing spring 190 is seated at its other end in a recess 191 in the upper end of housing 114 and acts downwardly against carrier flange 176 to urge the carrier 155 and thus also contact bridge 141 and plunger 146 in a downward direction toward the "open" position of the contacts shown in FIG. 1.

The stop sleeve 160 rests against the upper end of plunger 146 and similarly extends upwardly through the central bore in pole piece 211, but terminates below the contact bridge 141. The relative radial dimensions are such that contact bridge 141 may slide upon carrier 155 and carrier 155 may slide within stop sleeve 160. Further still, stop sleeve 160 may slide within the aperture and pole piece 211. The stop sleeve 160 is a first relatively small diameter over most of the lower portion of its length and also over a small pilot portion 161 at its upper end. That diameter is sufficiently small to allow relative slidable insertion of the pilot portion 161 within the aperture through contact bridge 141. At a midportion of stop sleeve 160 upwardly of pole piece 211 there is provided a radial enlargement or flange 151 which serves as a spring seat for the lower end of cushioning spring 150. Intermediate the flange 151 and the pilot portion 161, there is provided a sleeve head portion 163 of intermediate diameter, which serves as a stop for contacting engagement with contact bridge 141. More specifically, the upper surface of sleeve head portion 163 is positioned to engage a pair of bosses or stops 166 which are formed on the undersurface of contact bridge 141, as by upset pressure applied to relevant areas of the bridge.

The cushioning spring 150 is a coil spring positioned in compression between the upper surface of sleeve flange 151 and the lower or inner surface of contact bridge 141 for urging the contact bridge relatively upwardly against the limiting undersurface of carrier flange 176. In accordance with the invention, the cushioning spring 150 is positioned entirely radially outward of the sleeve head portion 163 such that it does not interfere with, or limit, contact of that head portion with the stops 166 on the contact bridge 141. Moreover, care is taken to ensure that the cushioning spring 150 does not fully compress, or "bottom out", before sleeve head portion 163 and the contact bridge stops 166 make contact. This is most easily accomplished by making spring 150 substantially longer than the maximum spacing between those two elements such that ample compression displacement remains. The carrier 155 is pressed into the axial bore 157 and plunger 146 to a depth which gives the desired axial spacing between contact bridge stop 166 and sleeve head portion 163 when the armature assembly 140 is in the "open" position depicted in FIG. 1.

Figure 2:
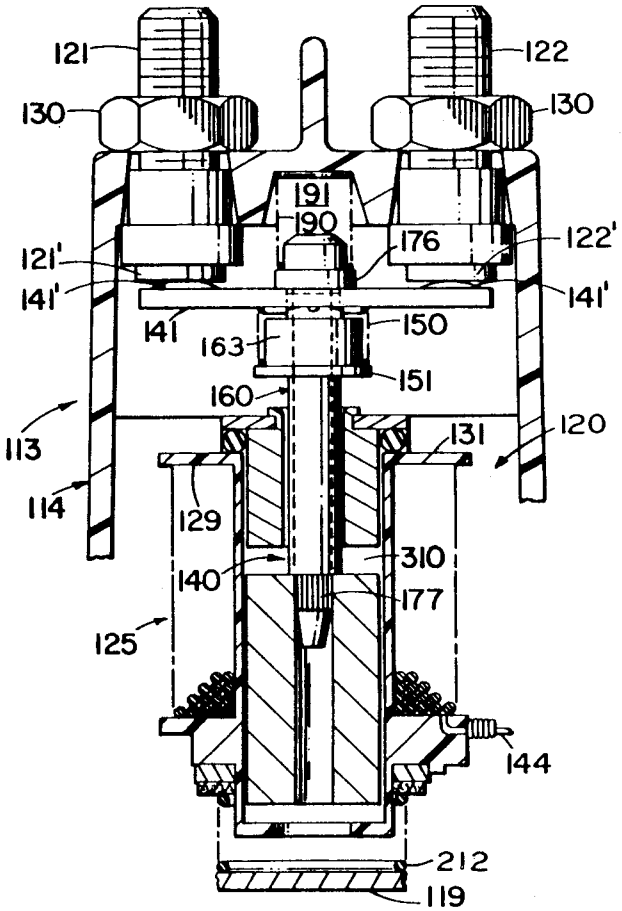
FIG. 2 is a view of the solenoid arrangement similar to FIG. 1 but showing the armature assembly in its "make" position.
Figure 3:
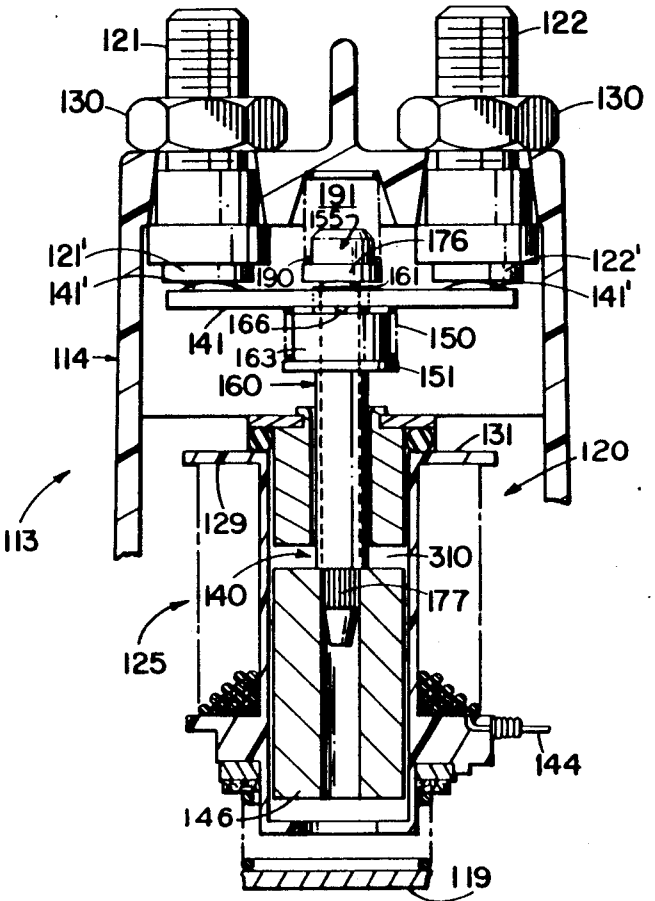
FIG. 3 is a view of the solenoid arrangement similar to FIGS. 1 and 2 but showing the armature assembly in its final, full "overtravel" position. (may need an enlarged fragmentary view?)

When a current is passed through the windings 135 of coil assembly 125 the resultant magnetic field acts upon plunger 146 in a known manner to draw it and the accompanying armature assembly 140 relatively upward. Such upward displacement of the armature assembly continues as a unit until the moment of contact "make", depicted in FIG. 2, when the contacts 141′ of contact bridge 141 initially contact the stationary contacts 121′, 122′. Since the biasing spring 190 yields prior to the cushioning spring 150, the armature assembly 140 moves as a unit until the moment of impact of the moving contacts 141′ with the stationary contacts 121′, 122′. Thereafter, the armature assembly 140, with the exception of the contact bridge 141, continues its upward displacement in a mode of "overtravel". Such overtravel and resultant resilient compression of cushioning spring 150 serves firstly to minimize or prevent any contact bounce and secondly enables the plunger 146, via stop sleeve 160, to move into hard, force transmitting engagement with the contact bridge 141 to establish the small air gap 310 of predetermined dimension depicted in the "overtravel" position of FIG. 3. In this latter position, the plunger 146 has urged stop sleeve 160 and its head portion 163 upwardly into stop-limited engagement with the stops 166 depending from the undersurface of contact bridge 141. Thus, a very precise determination of the axial dimensioning of the air gap 310 is made possible.

In accordance with the invention, the stops 166 in preferred form comprise a pair of radially-extending, semicylindrical bosses formed diametrically opposite one another in the undersurface of contact bridge 141 as by a stamping operation. Further, it is preferable that the axis of the cylindrical bosses be substantially perpendicular to the axis of the armature 146 and arranged in quadrature with a line extending between the pair of movable contacts 141′ disposed at opposite ends of the contact bridge 141. The cylindrical bosses or stops 166 are positioned near the center of the contact bridge 141 such that the final contact pressure between the two contact sets, i.e. 141′–121′ and 141′–122′, is equalized.

The axial dimension of the small air gap 310 in the "overtravel" position is such that the plungar 146 is prevented from seating against the pole piece 211, even following some contact wear which results from long term operation. Because a small air gap remains, the movable contacts 141' are assured of being maintained against the fixed contacts 121', 122' with maximum force while the coil remains energized. This improves contact continuity and reliability, especially in the case of copper contacts. It further lowers contact resistance, reduces heat rise in the contacts and extends the life of the overall contact or arrangement 113.

Although this invention has been shown and described with respect to detailed embodiments thereof, it will be understood by those skilled in the art that various changes in form and detail thereof may be made without departing from the spirit and scope of the claimed invention.

Having thus described a typical embodiment of my invention, that which is claimed as new and desired to secure by Letters Patent of the United States is:

1. An improved solenoid contactor arrangement comprising housing means, first and second stationary terminals mounted in the housing means and including respective first and second stationary terminal contacts within the housing, coil means mounted in said housing means for selectively producing a magnetic field, and an armature assembly within said housing means and responsive to said coil means magnetic field for making and for opening electrical contact between said first and second terminal contacts, said contactor arrangement being characterized by:

said armature assembly including plunger means for responding to said coil means by moving axially in response to a magnetic field produced by said coil means, a carrier subassembly joined to and moving with said plunger, and contact bridge means carried by said carrier subassembly for selectively making and opening electrical contact between said first and second terminal contacts;

stationary pole means fixed in axial register with said plunger, said plunger being reciprocable toward and away from said pole means;

first spring means for biasing said carrier assembly, said plunger and said contact bridge means toward an open limit position in which said contact bridge means is spaced from said first and second terminal contacts; and wherein said carrier subassembly includes an elongate carrier joined at one end to said plunger, a stop sleeve slidably mounted on said carrier and a second spring means of the coil type mounted coaxially with said stop sleeve, said contact bridge means being mounted on said carrier in axial slidable relation therewith and axially outward of said stop sleeve relative to said plunger, said carrier having a flange positioned distally of said stop sleeve and contact bridge means for limiting axial displacement of said stop sleeve and contact bridge means on said carrier to a predetermined range, said second spring means acting in compression at one end against said contact bridge means and at the other end against said stop sleeve for resiliently spacing said contact bridge means from said stop sleeve by said predetermined displacement range to cushion initial contact engagement between said contact bridge means and said first and second stationary terminal contacts, said second spring means being sufficiently yieldable for the carrier assembly to subsequently move to an overtravel limit position in which said stop sleeve is maintained in firm axial engagement with said contact bridge means by said plunger, and said plunger remains axially spaced from said pole means thereby to maximize the force with which said contact engagement between said contact bridge means and said first and second stationary terminal contacts is maintained.

2. The solenoid contactor arrangement of claim 1 wherein said stop sleeve includes a head portion for said firm engagement with said contact bridge means and a flange spaced axially beneath and extending radially outwardly of said head portion, said second spring means freely encircling said stop sleeve head portion in radially spaced relation and said other end thereof acting against said stop sleeve flange.

3. The solenoid contactor arrangement of claim 2 wherein said contact bridge means comprises a plate member having a plurality of bosses depending therefrom for contacting said stop sleeve head portion to provide said firm engagement therewith.

4. The solenoid contactor arrangement of claim 3 wherein said contact bridge means plate member includes a central aperture through which said carrier extends and said bosses are semicircular about an axis which extends radially of said plate member aperture.

5. The solenoid contactor arrangement of claim 4 wherein said contact bridge means plate is elongate in one direction for spanning said first and second stationary terminals and said plurality of bosses depending therefrom comprises two bosses diametrically opposite each other and in quadrature with the elongate direction of said contact bridge means plate.

* * * * *